United States Patent [19]

Vescia et al.

[11] 4,345,910

[45] Aug. 24, 1982

[54] DYEING OF NCD POLYESTER FIBERS

[75] Inventors: Michele Vescia, Limburgerhof; Sigismund Heimann, Ludwigshafen, both of Fed. Rep. of Germany

[73] Assignee: BASF Aktiengesellschaft, Ludwigshafen, Fed. Rep. of Germany

[21] Appl. No.: 233,300

[22] Filed: Feb. 10, 1981

[51] Int. Cl.[3] ..... D06P 1/651

[52] U.S. Cl. ..... 8/610

[58] Field of Search ..... 8/610

[56] References Cited

U.S. PATENT DOCUMENTS

| | | | |
|---|---|---|---|
| 3,236,583 | 2/1966 | Hees | 8/610 |
| 3,341,512 | 9/1967 | Wegmuller et al. | 8/610 |
| 3,617,211 | 11/1971 | Dawson | 8/610 |
| 3,706,530 | 12/1972 | Baumann et al. | 8/610 |
| 4,255,152 | 3/1981 | Hewitt et al. | 8/610 |

FOREIGN PATENT DOCUMENTS

| | | | |
|---|---|---|---|
| 249912 | 3/1964 | Australia | 8/610 |

*Primary Examiner*—Maria Parrish Tungol

*Attorney, Agent, or Firm*—Oblon, Fisher, Spivak, McClelland & Maier

[57] ABSTRACT

A process for dyeing polyester fibers which do not require a carrier with disperse dyes by the exhaustion method at 20°–100° C. and pH 4–6, with liquor ratios of from 5:1 to 100:1, and dyeing times of from 30 to 180 minutes, wherein the dyeing is carried out in the presence of from 0.5 to 20%, based on fiber weight, of a leveling agent consisting of an adduct of a $C_5$–$C_{14}$-alkylphenol or $C_5$–$C_{14}$-alkylnaphthol with from 4 to 25 moles of ethylene oxide.

4 Claims, No Drawings

DYEING OF NCD POLYESTER FIBERS

The present invention relates to a method of dyeing polyester fibers which do not require a carrier, referred to for brevity as non-carrier dyeing or NCD fibers, in which process oxyethylated alkylphenols or oxyethylated alkylnaphthols are employed as leveling agents.

Ordinary polyester fibers, i.e. those which cannot be dyed without a carrier, consist of polyethylene terephthalate, which is relatively highly crystalline, and can only be dyed satisfactorily at above 100° C., or using dyeing assistants referred to as carriers, which effectively increase the uptake of disperse dyes. However, a problem which remains when using carriers is that of dyeing blends of polyester fibers with other, heat-sensitive, fibers, i.e. in particular wool and polyurethane fibers. These other fibers become charged with carriers, which must subsequently be washed out. Increasingly, the use of carriers must be restricted for ecological reasons. Furthermore, high-temperature dyeing requires a relatively high expenditure of energy which is a cost factor of growing importance.

It is true that the NCD polyester fibers developed in recent years essentially still consist of polyethylene terephthalate. The latter is however modified, by incorporation of certain proportions of other units of the molecule, i.e. other dicarboxylic acids and/or hydroxycarboxylic acids and/or diols, in order to reduce the crystallinity and hence improve the dyeability, so that it is not necessary to use carriers or high temperatures, and less dye is required or deeper hues can be achieved with the same amount of dye.

The rapid uptake of disperse dyes on NCD polyester fibers however presents problems in obtaining level dyeings (cf., for example, J. Hürten, "Neue Erfahrungen mit carrierfrei färbbaren Polyesterfasern", Textilveredelung 12 (1977), 485–490). The levelness cannot always be controlled at the start of the dyeing process, even if the liquor and/or goods are thoroughly agitated and the temperature is carefully controlled. The use of fatty acid polyglycol ethers as leveling agents (P. Braun et al. "Untersuchungen an carrierfrei färbbaren Polyesterfasern", Chemiefasern/Textilindustrie (1976), 550–556, especially 554) is not a satisfactory remedy either.

It is an object of the present invention to provide a process for dyeing NCD polyester fibers with disperse dyes which avoids these disadvantages and reliably gives level dyeings in conventional equipment.

We have found that this object is achieved by the process stated in the claim.

The dyeings obtainable by this process are level even if the dye liquor and/or goods have only been agitated gently, and on dyeing rolls there is no evidence of ending.

The novel process is carried out under the conventional conditions for dyeing NCD fibers. These are as follows: from 0.01 to 15%, based on NCD fiber weight, of the disperse dye, depending on the type of dye and the desired depth of color; a dyeing temperature of from 20° to 100° C., preferably from 40° to 100° C.; a liquor ratio of from 5:1 to 100:1, preferably from 10:1 to 30:1, a dyeing time of from 30 to 180 minutes; and a pH of from 3 to 8, preferably from 4.5 to 5.5.

The novel leveling agent is employed in an amount of from 0.5 to 20%, preferably from 1 to 4%, based on the weight of the NCD fibers. Within these limits, the amount depends in the main on the nature and amount of the dye employed.

The leveling agent is an oxyethylated alkylphenol or alkylnaphthol, the alkyl moiety being of 5 to 14, preferably of about 9 carbon atoms. The degree of oxyethylation, i.e. the number of ethylene oxide molecules which have reacted to form the adduct, is from 4 to 25, preferably from 8 to 12.

The term disperse dye is familiar to a skilled worker and is to be found in the Color Index and also in L. Diserens "Die neuesten Fortschritte in der Anwendung der Farbstoffe", 2nd Edition, published by Birkhäuser, Basel, 1949, Volume 2, page 254 et seq. It requires no further explanation, particularly since virtually no other category of dyes can be used for dyeing polyester fibers.

The novel process achieves a substantial improvement in the levelness of the dyeings. Furthermore, it undoubtedly matters, from an ecological aspect, whether the dyeing assistant used is a carrier (virtually all of which are toxic) or is the comparatively non-toxic, substantially biodegradable, leveling agent according to the invention. Accordingly, the invention constitutes an advance in the art in two separate respects. This was surprising, since the compounds which prove excellent leveling agents for the process according to the invention have not proved very successful when dyeing ordinary polyester fibers and have therefore not found any acceptance in industry (cf. also Comparative Experiment 9b).

In the Examples, percentages are by weight of the polyester fiber material being dyed.

EO stands for ethylene oxide and PO for propylene oxide.

EXAMPLE 1

10 g of a knitted fabric of commercial NCD polyester fibers (i.e. fibers of a polyethylene terephthalate modified with EO/PO block polymers) were dyed with a combination of 0.3% of Disperse Red 60 (C.I. 60,756)
0.3% of Disperse Blue 56 (C.I. 63,285)
1% of Disperse Yellow 5 (C.I. 12,790)

using 2% of a $C_9$-alkylphenol/10 EO adduct and a liquor ratio of 20:1, the method being as follows:

In a laboratory dyeing machine of the "Marney" type, the fabric was slowly agitated in the liquor (which had been brought to pH 5.5), whilst the latter was heated from 70° C. to the boil in the course of 20 minutes and then kept at the boil for 60 minutes. The fabric was then rinsed with hot and with cold fresh water and cleaned for 15 minutes at 70° C. in a solution containing 1.5 g/l of sodium dithionite and 3 ml/l of an NaOH solution of density 1.355. The fabric was then rinsed with hot water and cold water until the wash water was at pH 7. A level brown dyeing was obtained. Control dyeings without assistant, or with 1 or 2 g/l of an assistant based on an oxyethylated castor oil (47 moles of EO/mole of castor oil) proved very non-level. Dyeings using 1–2 g/l of an adduct of stearic acid with 6 EO, or of an adduct of oleic acid with 12 EO, proved equally non-level.

EXAMPLE 2

10 g of a knitted fabric of commercial NCD polyester fibers (different from those used in Example 1, but of a basically similar type) were dyed with a combination of 0.5% of Disperse Blue 56 (C.I. 63,285)
0.2% of Disperse Orange 13 (C.I. 26,080)

0.8% of a disperse dye of the following chemical structure

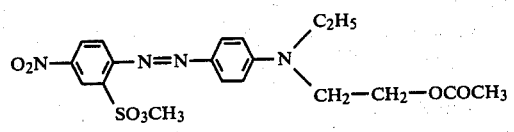

using a liquor ratio of 20:1, in the presence of 2% of an adduct of isooctylphenol with 6 moles of ethylene oxide. The dyeing process was carried out as described in Example 1. A level beige dyeing was obtained; in contrast, a control dyeing without assistant proved non-level.

EXAMPLE 3

10 g of knitted fabric of commercial, NCD polyester fibers (polyethylene terephthalate modified with polyethylene oxide) were dyed with a combination of 0.5% of Disperse Red 60 (C.I. 60,757)

0.5% of Disperse Yellow 5 (C.I. 12,790)

using a liquor ratio of 20:1, in the presence of 1% of a $C_{14}$-alkylphenol/9 EO adduct. The dyeing method was as in Example 1. A level orange dyeing was obtained; in contrast, the control dyeing without assistant was non-level.

EXAMPLE 4

10 g of a knitted fabric of the same NCD polyester fibers as in Example 3 were dyed with the same dye combination as in Example 3, using a liquor ratio of 30:1, in the presence of 4% of a $C_9$-alkylphenol/20 EO adduct. The dyeing method was as in Example 1. A level dyeing was obtained; in contrast, the control dyeing without assistant was non-level.

EXAMPLE 5

A strip, 13 cm wide and 8 m long (500 g), of a knitted fabric of the same NCD polyester fibers as in Example 1 was wound on a perforated drum and dyed in a laboratory dyeing machine, with 0.26% of Disperse Yellow 54 (C.I. 47,020)

0.27% of Disperse Red 60 (C.I. 60,750)

0.21% of Disperse Blue 56 (C.I. 63,285)

using a liquor ratio of 20:1 at pH 5.5, the liquor circulating outward at a flow rate of 15 l/kg/min. 2% of a $C_9$-alkylphenol/9 EO adduct was used as the assistant. The dye liquor was heated from 70° C. to the boil in the course of 15 minutes and kept at the boil for 60 minutes. After dyeing, the fabric was rinsed, reductively cleaned and again rinsed, as described in Example 1. The fabric strip showed a level olive green shade and no evidence of ending. A control dyeing without assistant showed a very non-level effect over the entire strip, and a great difference in hue between the inside and outside of the roll.

EXAMPLE 6

10 g of a knitted fabric of the same NCD polyester fibers as in Example 2 were dyed with the same dye combination as in Example 5, using a liquor ratio of 20:1 and 2% of a $C_9$-dialkylphenol/16 EO adduct. The dyeing method was as in Example 1. A level dyeing was obtained; in contrast, the control dyeing without assistant was non-level.

EXAMPLE 7

10 g of a knitted fabric of NCD polyester fibers (®Diolen 42) were dyed with 0.5% of Disperse Yellow 54 (C.I. 47,020)

0.2% of Disperse Red 65 (C.I. 11,228)

0.2% of a blue disperse dye of the following structure

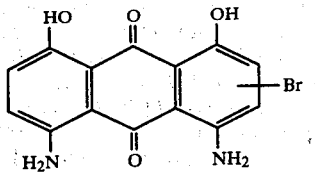

by the method described in Example 1, using a liquor ratio of 20:1 and 4% of a pentyl-2-naphthol/12 EO adduct. The brownish olive dyeing obtained was level, whilst a comparative dyeing without assistant was non-level.

EXAMPLE 8

10 g of a knitted fabric of a fiber mixture consisting of 50 parts of NCD polyester fibers and 50 parts of wool were dyed with the dye combination of Example 1, using a liquor ratio of 20:1, in the presence of 2% of a $C_9$-alkylphenol/10 EO adduct, as described in Example 1. The dyeing obtained was level, whilst a parallel dyeing without assistant was non-level. The difference in levelness was particularly discernible if the wool constituent of the fiber blend was dissolved out by a treatment, at room temperature, with a solution of 30 ml/l of concentrated sodium hydroxide solution, of density 1.355, per liter.

EXAMPLE 9

Migration Experiments (a) 20 g of a knitted fabric of NCD polyester fibers were dyed, using a liquor ratio of 20:1, with 0.6% of Disperse Orange 26 (C.I. 26,077) at 100° C. and pH 5. The fabric was then reductively cleaned with sodium hydroxide solution and sodium dithionite, as described in Example 1.

10 g of the material predyed as described above were then treated, together with 10 g of an undyed identical polyester material, for 60 minutes in a boiling aqueous bath at pH 5, using a liquor ratio of 20:1, in the presence of 4% of a $C_9$-alkylphenol/10 EO adduct. After this migration experiment, the originally white undyed material showed almost the same depth of color as the predyed material.

A comparative experiment with predyed and undyed material, but without assistant, showed that in this case only very little dye migrated from the predyed material to the undyed material.

(b) 20 g of a knitted fabric of ordinary polyester fibers (which can be dyed only in the presence of a carrier or at above 100° C.) were dyed with 0.6% of Disperse Orange 26 (C.I. 26,077) for 90 minutes at 120° C., using a liquor ratio of 20:1, and were then reductively cleaned as described in Example 1.

10 g of the predyed material and 10 g of an identical undyed material were then jointly treated for 60 minutes at 120° C. and pH 5 with 4% of a $C_9$-alkylphenol/10 EO adduct, using a liquor ratio of 20:1. The same experiment was also carried out with predyed and undyed material without addition of an assistant.

In both migration experiments (with and without assistant) it was found that only very little dye migrated from the predyed material to the undyed material.

We claim:

1. A process for dyeing polyester fibers which do not require a carrier with disperse dyes by the exhaustion method at 20°–100° C. and pH 4–6, with liquor ratios of from 5:1 to 100:1, and dyeing times of from 30 to 180 minutes, wherein the dyeing is carried out in the absence of carriers and in the presence of from 0.5 to 20%, based on fiber weight, of a leveling agent consisting of an adduct of a $C_5$–$C_{14}$-alkylphenol or $C_5$–$C_{14}$-alkylnaphthol with from 4 to 25 moles of ethylene oxide.

2. A process as claimed in claim 1, wherein an adduct of an alkylphenol or alkylnaphthol with from 8 to 12 moles of ethylene oxide is employed.

3. A process as claimed in claim 1 or 2, wherein an oxyethylated alkylphenol or alkylnaphthol where alkyl is of 9 carbon atoms is employed.

4. The process of claim 1, wherein said leveling agent is $C_5$–$C_{14}$-alkylnapthol with from 4–25 moles of ethylene oxide.

* * * * *

UNITED STATES PATENT AND TRADEMARK OFFICE

CERTIFICATE OF CORRECTION

PATENT NO. : 4,345,910

DATED : August 24, 1982

INVENTOR(S) : Michele Vescia et al

It is certified that error appears in the above-identified patent and that said Letters Patent is hereby corrected as shown below:

ON THE TITLE PAGE THE FOLLOWING SHOULD BE ADDED:

[30] -- Foreign Application Priority Data

March 5, 1980 [DE] Fed. Rep. of Germany... 3008388 --

Signed and Sealed this

*Twelfth* Day of *October 1982*

[SEAL]

*Attest:*

GERALD J. MOSSINGHOFF

*Attesting Officer*

*Commissioner of Patents and Trademarks*